US006488784B1

(12) United States Patent
Fortunati et al.

(10) Patent No.: US 6,488,784 B1
(45) Date of Patent: Dec. 3, 2002

(54) PROCESS FOR THE PRODUCTION OF GRAIN ORIENTED ELECTRICAL STEEL STRIPS

(75) Inventors: Stefano Fortunati, Ardea (IT); Stefano Cicale', Rome (IT); Giuseppe Abbruzzese, Montecastrilli (IL)

(73) Assignee: Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/623,955

(22) PCT Filed: Mar. 8, 1999

(86) PCT No.: PCT/EP99/01466

§ 371 (c)(1),
(2), (4) Date: Nov. 6, 2000

(87) PCT Pub. No.: WO99/46413

PCT Pub. Date: Sep. 16, 1999

(30) Foreign Application Priority Data

Mar. 10, 1998 (IT) ..... RM98A0149

(51) Int. Cl.[7] ..... H01F 1/147
(52) U.S. Cl. ..... 148/308; 148/111
(58) Field of Search ..... 148/110–113, 306–308

(56) References Cited

U.S. PATENT DOCUMENTS

| | | | | |
|---|---|---|---|---|
| 4,225,366 A | | 9/1980 | Harase et al. | 148/111 |
| 4,579,608 A | * | 4/1986 | Shimizu et al. | 148/111 |
| 5,370,748 A | | 12/1994 | Suga et al. | 148/111 |
| 5,702,541 A | * | 12/1997 | Inokuti | 148/308 |
| 5,718,775 A | * | 2/1998 | Komatsubara et al. | 148/307 |
| 5,858,126 A | * | 1/1999 | Takashima et al. | 148/308 |

FOREIGN PATENT DOCUMENTS

| | | |
|---|---|---|
| EP | 0318051 | 5/1989 |
| EP | 0326912 | 8/1989 |
| EP | 0339474 | 11/1989 |
| EP | 0494730 | 7/1992 |
| EP | 0539858 | 5/1993 |
| EP | 0566986 | 10/1993 |
| EP | 0743370 | 11/1996 |
| JP | 4126533 | 4/1966 |
| JP | 5119125 | 12/1980 |
| JP | 6306743 | 1/1994 |
| WO | WO9828451 | 7/1998 |
| WO | WO9828452 | 7/1998 |
| WO | WO9841659 | 9/1998 |
| WO | WO9841660 | 9/1998 |

* cited by examiner

*Primary Examiner*—John Sheehan
(74) *Attorney, Agent, or Firm*—Abelman, Frayne & Schwab

(57) ABSTRACT

By forming, after the annealing of the continuously cast body, a limited number of precipitates apt to the control of the grain growth, and utilising a cold rolling reduction ratio of at least 70%, it is possible to obtain in a subsequent step of continuous nitriding the direct formation of nitrides useful for the grain growth control and subsequently, still in a continuous treatment, to at least start the oriented secondary recrystallization.

14 Claims, No Drawings

PROCESS FOR THE PRODUCTION OF GRAIN ORIENTED ELECTRICAL STEEL STRIPS

FIELD OF THE INVENTION

The present invention refers to a process for controlling and guiding the secondary recrystallization in the production of grain oriented electrical steel strips and, more precisely, to a process in which during a continuous treatment after primary recrystallization it is possible to complete, or at least to start, the oriented secondary recrystallization.

STATE OF THE ART

It is known that, in the grain oriented electrical steel strips, the desired final magnetic characteristics are obtained through a complex series of interdependent transformations of the strip structure, which occur during a final treatment of secondary recrystallization. This step, here understood as the one in which the grains having Miller index <001> (110) develop with higher velocity, was up to now obtained during an extremely long annealing treatment at high temperature in static annealing furnaces (box annealing) in which tightly wound cold coils of the strip having the desired final thickness are introduced, having a weight typically comprised between 6 and 18 tons, which coils are annealed, cooled and then discharged. This static annealing also eliminates from the strip elements which would impair its final quality and forms on the strip surface a coating, called "glass film", useful to electrically insulate the strip and to act as a substrate for further necessary coatings.

This box annealing, however, has some major disadvantages, among which the long duration of the treatment, requiring some days, and the fact that a single batch comprises a plurality of coils. Those coils, due to the high treatment temperatures and times, are deformed under their own weight, which makes it necessary to eliminate the deformed zones through a slitting operation. More scrap is produced due to sticking of adjacent coil spires, which occurs even if oxide powder annealing separators are utilised. Still more scrap is due to quality problems (deriving both from damages attributed to the handling of coils during loading and unloading of box annealing furnaces and from different treatment conditions experienced by the most external and the most internal spires of the coils during the slow annealing process) which call for the elimination of the initial and final spires of the coils. Moreover, the process imparts to the strips the form due to coiling, which strips will have to be further treated to bring them back to a flat shape, necessary for the manufacture of the final products, usually transformers cores.

Further disadvantages, deriving from the box annealing utilised for the metallurgical final treatment of the grain oriented strips, relates to the process control.

In fact, while on one hand the high temperature purification of the strip, substantially obtained through solid phase extraction of elements such as sulphur and nitrogen by interaction with the annealing atmosphere, is not critically influenced by the atmosphere and temperature differences along the coiled strip (longitudinal and transversal gradients), on the other hand the grain growth and oriented secondary recrystallization are greatly influenced by such differences. In fact, due to the microscopic scale of such metallurgical processes and to the peculiarities of the oriented secondary recrystallization, the course of the process is critically controlled by the physical and chemical "micro-environment" in which the different parts of the strip are.

To better clarify the importance of the process control during the final metallurgical annealing as well as the relevant difficulties linked to a static thermal treatment, some details will hereinafter be exposed with reference to the state of the art and to the physical and chemical phenomena occurring during the treatment. The final result of the oriented secondary recrystallization is a polycrystalline structure iso-oriented along the crystallographic direction of easier magnetisation (<100> according to the convention of the Miller indexes), with an angular dispersion, for a good industrial product, lesser than 100. This is obtained through a delicate process which selects for the growth only crystals already having the above orientation, such crystals representing, before the final annealing, a very small fraction of the starting microstructure. In this process, a dimensional change occurs in the product structure which varies from some micrometers before the annealing to some millimeters after.

The desired result of this process, difficult to obtain at industrial scale, strongly depends on the treatment conditions preceding the final annealing and determining geometry, the superficial state and the microstructure of the strip. As already mentioned, this result is obtained during the final metallurgical annealing in a way critically controlled by the evolution kinetics of the dimensions of some. particles such as sulphides and nitrides present in the metallic matrix and by the diffusion of relevant composing elements between the same particles as well as towards the strip surface, and through the latter towards both the exterior and the interior of the metal matrix. The last two phenomena are controlled by interaction with the annealing atmosphere (micro-environment).

Even small variations in the kinetics of said processes (as well as of the temperatures at which the same are activated and developed) in different zones of the strip depending on different micro-environments produced during the box annealing, bring to differences in the development of the grain growth, which in the best case mean final grain dimensions and orientation different from zone to zone, entailing variations of the magnetic characteristics along the strip and in the transverse direction.

In more critical cases, which however are not so rare in the industrial practice, such differences lead to a loss of control in the oriented secondary recrystallization, with totally inadequate magnetic characteristics in part of the final product, which must thus be further conditioned at the end of the production cycle, or downgraded or scrapped.

For analogous reasons the chemical reactions at the surface depend on the micro-environment: for instance, the superficial oxidation layer evolution with time and during the thermal treatment strongly influences the exchange reaction between the metal matrix and the annealing atmosphere, further complicating the already delicate aspects of the metallurgical process control.

The differences between the different superficial reactions induced by the different micro-environments depending on the coil geometry (head and tail of the strip, external layers and core of the coil, and so on) more directly lead to differences in morphology and composition of the superficial layer of the strips.

The superficial characteristics are another important aspect of the grain oriented strips, in that they directly or indirectly influence the magnetic and insulation characteristics thereof. Thus, variations of the superficial quality along the strip constitute an industrial problem of product quality and hence of process control. It is clear now that the box annealing of grain oriented electrical steel strips having the final thickness, utilised to start and develop the oriented secondary recrystallization, as well as to modify surface structure and morphology and to purify the matrix of some elements not desired in the final product, is a treatment technique for some aspects inconvenient and expensive, in that requires a large number of plants to sustain an adequate production capacity, has a low productivity, physical yields difficult to control, and above all do not allows to perform a process control absolutely necessary for such a complicated production and which is present in all the other production steps, form the steel shop production to the primary recrystallization.

As already said, the secondary recrystallization process consists, in this kind of products, in the selective growth of some grains having a specific orientation with respect to the rolling direction and the strip surface. Trough a complex process, well known to the experts, it is possible to let grow mainly the desired grains, utilising the so called grain-growth inhibitors, i.e. non-oxide precipitates (sulphides, selenides, nitrides) which interact with the grain boundaries impairing and/or preventing the movement thereof (and thus the grain growth).

If the inhibitors are homogeneously distributed through the matrix, the grain structure becomes slightly sensible to the thermal treatment, up to a temperature at which the specific inhibitors, with reference to their own thermodynamic stability into the alloy and to the metal matrix chemical composition, start modifying their dimensions through a process of dissolution or dissolution and growth, in any case with the net result of a progressive reduction of the number of precipitates (the grain growth physical phenomenon is controlled by the surface amount of second phases interfacing the metallic matrix).

At the same time of this process the grains boundaries can start to significantly move letting to grow those grains which can do it earlier and faster. If there was an appropriate process control during the whole cycle and during the final annealing, only few grains will selectively grow, for reasons well known to the experts, with the desired orientation, with an axis <100> parallel to the rolling direction, according to the Miller indexes. The higher the temperature at which this process happens, the better is the orientation of the grown grains and the better are the final magnetic characteristics of the product.

Each kind of inhibitor has it own solubilization temperature, rising from the sulphides and selenides to nitrides. Due to the slow heating of the coils in the final box annealing, the real solubilization temperature of the inhibitors essentially corresponds to the thermodynamic one, and hence the secondary recrystallization temperature is fundamentally linked to the inhibitor type utilised and to the alloy composition.

Therefore, the possibility to enhance the magnetic characteristics of the final product is roughly limited essentially by the dissolution temperature of the chosen inhibitor.

It is useful, at this point, to remind how the inhibitors useful for the grain growth control are formed.

During the relatively slow solidification processes of the liquid steel during the casting thereof and the subsequent cooling, the elementary components of the inhibitors, which unhomogeneously concentrate in some zones of the matrix due to the segregation enhanced by the slowness of such processes, can easily aggregate in unevenly distributed coarse particles, useless for an effective inhibition of the grains boundaries movement, and hence for the growth thereof, up to the desired temperature.

Since the transformation process of silicon steel down to a strip comprises a number of high temperature treatments, obviously in each one of said treatments an uncontrolled grain growth could start, with a consequent, probably high, loss of quality. This is the reason why the processes commonly utilised for the production of electrical steel strips comprise a high temperature treatment of the continuously cast body (usually a slab), to dissolve the coarsely precipitated inhibitors, to be later reprecipitated in a more fine and uniformly distributed form.

After this treatment, all the other high temperature treatments must be carefully controlled to avoid or limit the variations in the dimensional distribution of the second phases particles; such a control is obviously very delicate and difficult. Answering to the above problems it was proposed, for instance in U.S. Pat. No. 4,225,366 and EP 0 339 474, to radically modify this procedure, maintaining practically unmodified the coarse precipitates obtained during the steel solidification, performing all the subsequent treatments at temperature lesser than the usual ones, and forming the inhibitors useful for the grain growth inhibition only in the last steps of the process, through introduction of nitrogen into the strip, thus forming nitrides.

This technology which, at least as per its basic aspects, was proposed in 1966 (Japan Patent application, priority number 41-26533), still has some inconveniences at the industrial level, among which the fact that, due to lack of inhibitors, all the thermal treatments, even at relatively low temperatures, must be carefully controlled to avoid an undesired grain growth, and that the distribution of inhibitors, useful for the control of grain growth and of oriented secondary recrystallization, is obtained during the slow heating to the annealing temperature during the final box annealing, either through nitrogen permeation directly in this phase, and subsequent diffusion and precipitation as nitrides throughout the thickness of the strip, or through a continuous nitriding (before the box annealing) which, however, is necessarily limited at not so high temperatures thus producing, at the strip surface, the precipitation of low-stability nitrides, substantially with silicon which, being abundantly present in the metal matrix, will bond the nitrogen near the strip surface, blocking its further diffusion. Such silicon based nitrides are useless for the desired grain growth inhibition and, only during the subsequent slow heating in the box annealing, will decompose thus releasing nitrogen which can now diffuse into the strip and form the desired stable aluminium-based nitrides (Takahashi, Harase: Materials Science Forum, 1966, Vol. 204—204, pages 143–154; EP 0 494 730 A2, page 5, lines 3–44).

This Applicant, aware of the difficulties proper of the known processes for the production of oriented grain electrical steel strips, did develop an original and highly innovative technology, according to which it is useful to permit in the continuously cast steel, after the high temperature annealing of the cast body, or after the hot rolling, the formation of a limited quantity of useful inhibitor precipitates, to attenuate the criticality of the treatment temperatures, and, more specifically, to utilize during the continuous nitriding sufficiently high temperatures to consent the penetration of nitrogen throughout the strip thickness and, at the same time, to directly form aluminium-based nitrides, having a morphology useful to control the grain growth inhibition.

The above technology is described in the PCT Applications PCT/EP97/04005, PCT/EP97/04007, PCT/EP97/04080 and PCT/EP97/04089. Tough the above described new technologies represent important steps in the production of electrical steel strips, either of the "conventional oriented grain" type (with magnetic permeability up to about 1890 mT) or of the "super-oriented" type (with magnetic permeability higher than 1900 mT), there are still many important points requiring extensive studies and adequate solutions.

Among such points there is the static box annealing which, as previously described, is still considered essential for the obtainment of the desired magnetic properties and world-wide utilised by the electrical steel producers, though presenting important problems of productivity, costs and process control.

An object of the present invention is to obviate to the described inconveniences, proposing a process in which the secondary recrystallization, up to now obtained exclusively in the box annealing furnaces, is realised, or at least significantly started, in a quick continuous treatment following the primary recrystallization and the nitriding with direct formation of aluminium-based nitrides, thus making it possible to have a more adequate process control during the oriented secondary recrystallization phase, and permitting to chose the recrystallization starting temperature, thus facilitating and rendering less critic the box annealing furnaces management.

DESCRIPTION OF THE INVENTION

According to present invention, a process for the production of grain oriented electrical steel strip comprising the steps of (i) preparing a silicon steel liquid bath of desired composition, (ii) continuously casting said steel, (iii) treating the continuously cast body at a temperature of between 1100 and 1300° C., to correct the heterogeneous distribution of inhibitors in the cast body through their non complete solubilization and subsequently hot rolling to reprecipitate in a fine and uniformly distributed form the inhibitors previously dissolved, to obtain a given level of homogeneous inhibition, (iv) cold rolling the steel, is characterised by the combination in co-operation relationship of the following steps:

a) cold rolling with a reduction rate of at least 70%,
b) continuous annealing for primary recrystallization at a temperature comprised between 700 and 1000° C., preferably between 800 and 900° C., also comprising possible decarburization and controlled superficial oxidation phases;
c) subsequent continuous treatment at a temperature comprised between 800 and 1100° C., preferably between 900 and 1000° C., in a nitriding atmosphere apt to directly obtain nitrides useful for the grain growth inhibition up to a high temperature, evenly distributed throughout the strip thickness;
d) further continuous treatment at a temperature comprised between 1000 and 1200° C., preferably between 1050 and 1150° C., in a nitrogen-hydrogen containing atmosphere to carry out, or at least start, the secondary recrystallization process;
e) possible further continuous thermal treatment at high temperature.

This last high temperature treatment can be carried out in a nitriding atmosphere. The steel to be used according to present invention comprises, in weight percent, the following elements: Si 2.0–5.5; C 0.003–0.08; $Al_s$ 0.010–0.040; N 0.003–0.010; Cu 0–0.40; Mn 0.03–0.30; S 0.004–0.030; Sn≦0.20; also other elements can be present such as Cr, Mo, Ni, in a total amount lesser than 0.35% b/w. Moreover, also other useful nitride-forming elements can be present, such as Ti, V, Zr, Nb. The remaining of steel is essentially iron and unavoidable impurities.

Preferably, some elements must be present in the following amounts, in weight percent: C 0.03–0.06; $Al_s$ 0.025–0.035; N 0.006–0.009; Mn 0.05–0.15; S 0.006–0.025. Copper can also be present in amounts comprised between 0.1 and 0.2% b/w.

The liquid steel can be continuously cast in any known method, also utilising thin slab or strip continuous casting.

During the cooling after the high temperature heating of the continuous cast body, and during the hot rolling, working conditions are utilised, known to the experts, such to obtain a level of useful inhibition comprised between 300 and 1400 $cm^{-1}$, expressed by the formula:

$$lz=1,9\ fv/r$$

in which lz is the inhibition level, fv is the volumetric fraction of useful precipitates and r is the mean dimension of same precipitates.

The grain dimensions produced during the primary recrystallization and the subsequent controlled growth are adjusted through decarburization temperature and duration; the relationship between those two treatment parameters and the obtained grain dimensions depends on the utilised chemical composition, on the cast body heat cycle and on the strip thickness.

The grain dimensions obtained before the nitriding treatment depend also on the time the strip takes to reach the treatment temperature during the continuous treatment.

For example, following table 1 shows the correlation between grain dimensions and treatment temperature, for a steel strip 0.30 mm thick, containing Al 290 ppm, N 80 ppm, Mn 1400 ppm, Cu 1000 ppm, S 70 ppm, hot rolled with a slab heating temperature of 1300° C.; the grain dimensions were obtained analysing rolled specimens processed at different temperatures in the first part of the continuous thermal treatment, and stopping the treatment before the high temperature nitriding step.

TABLE 1

| Temperature, ° C. | Mean grain diameter, μm |
|---|---|
| 830 | 18 |
| 850 | 20 |
| 870 | 22 |
| 890 | 25 |

If steel compositions are utilised having very low carbon content, it can be not necessary to control the decarburization, usually associated to the primary recrystallization.

The nitrogen which deeply penetrates into the steel strip during the high temperature nitriding, preferably forms aluminium-based nitrides. However, in the present invention, it is also possible to utilize other useful nitride forming elements, such as, for instance, Ti, V, Zr, Nb.

The high temperature treatment following the nitriding step is meant to start, and possibly to complete, the oriented secondary recrystallization. Indeed, it is possible to complete the nitriding step in a time lesser than the one of strip transit in the nitriding furnace. This can advantageously utilised to at least start the secondary recrystallization within the nitriding furnace. However, the continuous treatment tending to at least start the secondary recrystallization could also be carried out in another furnace, even after the strip cooling.

By the expression "starting of the oriented secondary recrystallization" the process is meant according to which a small fraction of the grains, present in the matrix and having the orientation desired for the final product, start to quickly and significantly grow, reaching a dimension strikingly different (greater) than the one of the remaining grains (mean dimension). In the present invention, the selective growth of said fraction of grains is such that the interested grains can be seen with the naked eye (their major dimension being evaluated at around 0.3 mm) at the end of the continuous annealing treatment, after an appropriate sample preparation.

At least some of the various heating steps of the process above described, can be carried out at high speed, of about 400–800° C./s; in such a way the time can be raised during which the strip can be maintained at the treating temperature, the plant length being equal, thus rising the process productivity.

Moreover, as it is known, a quick heating at high temperature for the primary recrystallization results in a larger number of crystalline nuclei being involved in the process as well as of the crystals that subsequently can grow. Consequently, to the secondary recrystallization will correspondingly participate a larger number of grains, speeding up the secondary recrystallization process, which starts and ends earlier.

Obtaining the treating temperature at such a high speed, and however at the typical speed of the continuous annealing treatments, during the third phase of the cycle according to present invention (immediately after the nitriding step) allows to a priori define the temperature at which the secondary recrystallization will start, contrary to the process in the box annealing furnaces in which, due to the inevitably low heating speed, the secondary recrystallization starting temperature is linked in a complex and not controllable way to the kind of inhibitor utilised and to the ensemble of conditions and micro-environments which are established on the strip surface during the long treatment cycle.

According to present invention, the secondary recrystallization starting temperature as well as the temperature at which the same recrystallization develops and ends, are largely independent from thermodynamic and phisico-chemical limits such as the solubility of inhibitors components, diffusion coefficients, grain boundary mobility, and so on.

The realisation, or at least the starting, of the secondary recrystallization process during a continuous treatment subsequent to the primary recrystallization and to the formation of the desired inhibition within the strip metal matrix, allows also a very precise control, at the industrial scale production cycles, of the annealing conditions (e.g. temperature and composition of the annealing atmospheres). Such conditions can be ensured as constant on the whole length and width of the strip, and can be adjusted, according to the necessity, for each coil.

A further important characteristic of the present invention is the possibility to have a control of the final annealing process conditions, directly measuring at the exit of the continuous treatment line the magnetic characteristics resulting from the development of the secondary oriented recrystallization.

The use of continuous measures of magnetic characteristics at the end of a dynamic annealing treatment is a known technique, in some cases well established, to indirectly evaluate other metallurgical characteristics of the steel strip, such as the grain dimensions.

In this case, a direct measurement of the functional characteristics of the product can be performed, with obvious advantages on the process control practice. As far as the above is concerned, it is important to remind that in all the present production cycles of grain oriented electrical steel strip, practically utilised and also just described in the literature, the oriented secondary recrystallization is started and completed in a static annealing, and thus once started the annealing, involving usually a number of coils at the same time, it is impossible to change the treatment conditions in order to influence the results thereof. The final magnetic characteristics can, in fact, be evaluated only at the end of the subsequent treatment of thermal flattening and coating.

In the industrial practice, this is a dangerous limit which the producers were forced to accept up to now; should, however, some troubles creep in the process control during the production cycle, this could mean production of large quantities of product with low or even unacceptable quality, well before the recognition that some trouble occurred.

According to the present invention, after the secondary recrystallization in a continuous cycle, the strip can also be continuously treated to eliminate the nitrogen, now no more useful, as well as other elements detrimental for the steel final quality, and to undergo a final treatment to form protective and insulating coatings. With respect to this last treatment, it is also possible to carry out a bright annealing treatment, or the like, avoiding the formation of the glass film, in the case other type of coating are to be utilised, for instance thinner ones, to improve the space factor in the production of the final goods, for instance transformer cores.

The steel which underwent the secondary recrystallization annealing can also be further treated in box furnaces, for instance in order to eliminate sulphur; this treatment, however, is no more rigidly limited by thermal gradients, heating velocity and the like, hence its duration is drastically reduced.

The strip produced by the continuous treatment line can directly represent the final product, not considering a further insulating coating treatment to be carried out in another line, but which can be carried out also a continuous sequence process on the same line in which the primary recrystallization, the grain growth and the secondary recrystallization are obtained.

The technical and qualitative aspects of the present invention will now be illustrated with the following Examples, to be considered exclusively explicatory and not limiting of the characteristics and scope of present invention.

EXAMPLE 1

Some coils of silicon steel were industrially produced, all containing from 240 t0 350 ppm of acid soluble aluminium, but different from each other in composition, casting kind and conditions and hot rolling conditions. Relevant hot rolled strips, having a thickness comprised between 2.1 and 2.3 mm, were then processed to cold rolled strip 0.29 mm thick (in some cases utilising an industrial plant, in other cases utilising a research plant). In all the cases, before the cold rolling process the strips were sampled to be qualified in terms of non-oxidic inclusions content. The inhibition level of each sample was then estimated from the volumetric fraction of second phases and from the mean dimensions of the observed particles, according to the above defined relation $$lz=1,9fv/r$$

In the following Table 2 the values obtained for seven coils are presented:

TABLE 2

| Sample | a | b | c | d | e | f | g |
|---|---|---|---|---|---|---|---|
| lz ($cm^{-1}$) | 250 | 660 | 830 | 620 | 1015 | 2700 | 2010 |

The seven cold rolled coils were then continuous annealed according to the following cycle:

first zone: treatment at a temperature of 850° C, for 210 seconds in wet nitrogen-hydrogen atmosphere, with a $pH_2O/pH_2$ ratio of 0.58;

second zone: treatment at a temperature of 970° C. for 30 seconds in wet nitrogen-hydrogen atmosphere, with a $pH_2O/pH_2$ ratio of 0.03, in gaseous mixture containing ammonia with an equivalent flow rate of 50 liters of $NH_3$ per square meter of strip and per minute of treatment;

third zone: treatment at a temperature of 1120° C. in wet nitrogen-hydrogen atmosphere, with a $pH_2O/pH_2$ ratio of 0.01;

cooling in dry nitrogen down to 200° C. and subsequent air cooling to room temperature.

The strips thus produced were coated with a MgO based annealing separator and purified with a common annealing treatment according to the following thermal cycle:

(i) heating from 30 to 1200° C. in 3 hours, in a 50% nitrogen-hydrogen atmosphere;

(ii) soaking at 1200° C. for 3 hours in pure hydrogen atmosphere;

(iii) cooling in hydrogen to 800° C. and in nitrogen to room temperature. Each continuous annealed strip was sampled, and the samples acid pickled and then prepared in transversal section for metallographic microstructure observation. The same samples were analysed for the nitrogen content, and the nitrogen introduced through nitriding was calculated for each sample; Table 3 shows the results in terms of nitrogen introduced, percent fraction of secondary recrystallization grains and magnetic properties, measure after box annealing.

TABLE 3

| | a | b | c | d | e | f | g |
|---|---|---|---|---|---|---|---|
| [N] introduced, ppm | 126 | 133 | 152 | 180 | 112 | 156 | 122 |
| B800 (mT) | 1540 | 1940 | 1925 | 1930 | 1880 | 1590 | 1670 |
| P17 (W/kg) | 2.58 | 0.95 | 0.98 | 0.92 | 1.17 | 2.37 | 1.68 |
| Secondary recrystallization grains (% fraction) | 0 | 7 | 5 | 3 | 10 | 0 | 0 |

EXAMPLE 2

A 160 t heat was produced having the following composition, in wt % or in ppm: Si 3.2%, C 430 ppm, Mn 1500 ppm, S+Se 70 ppm, $Al_s$ 280 ppm, N 80 ppm, Sn 800 ppm, Cu 1000 ppm, the remaining being iron and inevitable impurities.

The stabs were heated at 1300° C. with a 3 hours cycle and hot rolled to 2.1 mm. The hot rolled strips were normalised (1050° C. for 40 s) and then cold rolled to 0.30 mm.

Part of the cold rolled strips (5 coils) was subjected to a recrystallization, nitriding and grain growth treatment similar to the one in the previous Example, while 5 coils were treated in the same line and in the same temperature and humidity conditions, but without ammonia addition in the nitriding zone.

All the coils were purified according to the previous Example.

The following Table 4 shows the ammonia amount utilised in the nitriding zone, the amount of added nitrogen and the magnetic characteristics obtained of each coil.

TABLE 4

| STRIP N° | $NH_3$ (l/($m^2$,min) | [N] introduced (ppm) | B800 (mT) |
|---|---|---|---|
| 1 | 50 | 120 | 1930 |
| 2 | 50 | 130 | 1920 |
| 3 | 50 | 115 | 1935 |
| 4 | 50 | 125 | 1915 |
| 5 | 50 | 140 | 1900 |
| 6 | 0 | 0 | 1540 |
| 7 | 0 | 0 | 1530 |
| 8 | 0 | 0 | 1550 |
| 9 | 0 | 0 | 1543 |
| 10 | 0 | 0 | 1520 |

EXAMPLE 3

Steel continuously cast bodies comprising, in wt % or in ppm: Si 3.2%, C 500 ppm, $Al_s$ 280 ppm, Mn 1500 ppm, S 35 ppm, N 40 ppm, Cu 3000 ppm, Sn 900 ppm, were heated at 1280° C. and then hot rolled to 2.1 mm; the hot rolled strips were then annealed at 1050° C. for 60 s an then cold rolled to 0.30 mm; the thus obtained strips were decarbonized in wet nitrogen-hydrogen at 850° C. for 200 s and nitrided at 900° C. in a mixture of nitrogen, hydrogen and ammonia, introducing 100 ppm of nitrogen into the strips. The same were then heated at 1100 ° C. in 3 minutes and kept at this temperature for 15 minutes in a nitrogen-hydrogen atmosphere, then cooled.

The mean B800 for those strips was 1910 mT.

EXAMPLE 4

A steel having the following composition, in wt % or in ppm: Si 3.1%, C 500 ppm, Mn 1350 ppm, S, 60 ppm, $Al_s$ 270 ppm, N 60 ppm, Sn 700 ppm, Cu 2300 ppm, the remaining being iron and inevitable impurities, was strip-casted at a thickness of 3 mm. The strip was then annealed at 1100° C. for 60 seconds and cold rolled to 0.30 mm.

The cold rolled strip was then decarbonized in a wet nitrogen-hydrogen atmosphere with a water/hydrogen ratio of 0.49. Part of the strips were nitrided at 950° C. for 40 seconds in a nitrogen-hydrogen atmosphere containing 10% of ammonia. The samples thus obtained underwent a secondary recrystallization treatment at 1150° C. for 20 minutes.

The samples were then purified according to the following cycle: (i) heating at 350° C./h in $N_2$+$H_2$ (50%—50%) up to 1200° C.; (ii) maintaining this temperature for 3 h in pure hydrogen; (iii) cooling in pure hydrogen.

Those samples did show a mean B800 of 1920 mT.

EXAMPLE 5

A liquid bath of an alloy Fe-3.3% Si was prepared, also containing C 250 ppm, $Al_s$ 280 ppm, N 40 ppm, Cu 1000 ppm, Mn 800 ppm, S 50 ppm, (Cr+Ni+Mo)=1400 ppm, and Sn 600 ppm.

The alloy was continuously cast as 60 mm thick slabs.

Such slabs were quickly transferred in a heating and homogenising furnace at a temperature of 1180° C. for 15 minutes, then hot rolled at a thickness comprised between 1.8 and 1.9 mm. Four strips were sandblasted, pickled and cold rolled to 0.23 mm thickness.

Four strips were sandblasted, pickled and cold rolled to 0.23 mm thickness. The cold rolled strips were then continuously annealed according to the following cycle:

decarburization at 870° C. for 150 s in wet nitrogen—hydrogen (50%) atmosphere, with a dew point of 62° C.;

nitriding for 50 seconds at 930° C. in a ($N_2$—$H_2$)+25% $NH_3$ having a $pH_2O/pH_2$ ratio of 0.1;

activation of the secondary recrystallization at 1120° C. for 100 seconds in nitrogen—hydrogen atmosphere (two coils; NH) and in hydrogen atmosphere (two coils; H);

coating with a MgO based annealing separator.

The strips were sampled and then annealed in couples (one NH strip and one H strip) in box annealing furnaces with two different treatment cycles at 1200° C. for hours, characterised by:

A) heating time from 700 to 1200° C., 33 hours;

B) heating time from 700 to 1200° C., 10 hours.

The magnetic characteristics of the final products thus obtained are shown in Table 5.

TABLE 5

| | B800, (mT) | P17, (W/kg) |
|---|---|---|
| Cycle A, Coil NH | 1940 | 0.90 |
| Cycle A, coil H | 1900 | 0.95 |
| Cycle B, coil NH | 1930 | 0.88 |
| Cycle B, COil H | 1820 | 1.45 |

Both kind of strips (NH and H) were sampled at the exit form the continuous annealing, were conditioned for annealing in laboratory furnaces, surface cleaned, coated again with a MgO based annealing separator and annealed according to the following final cycles;

1. from 600 to 1200° C. in 35 hours, in $N_2$—$H_2$ (1: 3), soaking at 1200° C. for 5 hours in $H_2$;
2. from 600 to 1200° C. in 10 hours, in $N_2$—$H_2$ (1;3), soaking at 1200° C. for 5 hours in $H_2$;
3. from 600 to 1200° C. in 3 hours, in $N_2$—$H_2$ (1;3), soaking at 1200° C for 5 hours in $H_2$.

The magnetic characteristics obtained are shown in Table 6.

TABLE 6

| | Cycle 1, NH | Cycle 1, H | Cycle 2, NH | Cycle 2, H | Cycle 3, NH | Cycle 3, H |
|---|---|---|---|---|---|---|
| B800 (mT) | 1930 | 1900 | 1930 | 1830 | 1920 | 1560 |
| P17 (W/kg) | 0.92 | 0.96 | 0.89 | 1.42 | 0.93 | 1.58 |

EXAMPLE 6

A steel bath was produced with a electric arc furnace, containing Si 3.2% b/wt, C 280 ppm, Al 350 ppm, N 60 ppm, S 30 ppm, Mn 50 ppm, Mn 750 ppm, Cu 2100 ppm, the remaining being iron and unavoidable impurities, present in the scrap. The liquid bath was continuously cast in slabs which were heated in walking beam furnaces at a maximum temperature of 1250° C., held for 15 minutes, treated in a roughing mill and then hot rolled at a final thickness comprised between 2.1 and 2.2 mm.

The strips were then continuously annealed at a maximum temperature of 1100° C.; six of them were cold rolled in a single step at a thickness of 0.22 mm.

The cold rolled strips were then processed in a multi-zone continuous treatment line, according to the following cycle:

first zone, treatment at 850° C., for 180 seconds, in wet nitrogen-hydrogen atmosphere with a $pH_2O/pH_2$ ratio of 0.6;

second zone, treatment at 950° C. for 25 seconds in wet nitrogen-hydrogen atmosphere with a $pH_2O/pH_2$ ratio of 0.05, in mixture with ammonia having a variable equivalent flow rate;

third zone, treatment at 1100° C. for 50 seconds, in wet nitrogen-hydrogen atmosphere with a $pH_2O/pH_2$ ratio of 0.01;

fourth zone, treatment at 970° C. for 25 seconds, in wet nitrogen-hydrogen atmosphere with a pH20/$pH_2$ ratio of 0.05;

cooling in dry nitrogen to 200° C. and then air cooling to room temperature.

For two of the processed strips (DN) in the second and fourth zone to the annealing gas a flux of nitrogen of 40 l per strip square meter an per minute of treatment was added; for other four strips, there was no ammonia in the fourth zone while in the second zone the ammonia was maintained for two strips (SN1) at 40 l per strip square meter and per minute of treatment, and for the others (SN2) at 60 l per strip square meter and per minute of treatment. The strips were then sampled and analysed for the nitrogen contend and for grain structure, and then subjected to a purification and secondary recrystallization completion annealing, at a maximum temperature of 1200° C. for 3 hours in hydrogen, including the heating time from 200° C., and cooled at 100° C./s to 600° C. The results as per chemical analysis and structure (after the continuous annealing treatment) as well as for magnetic characteristics for the six strips are shown in Table 7.

TABLE 7

| | Continuous annealing | | | Final annealing | |
|---|---|---|---|---|---|
| | Nitrogen (ppm) | Al as AlN | Secondary recr. fraction, % | B800 (mT) | P17 (W/kg) |
| SN1 | 200 | 230 | 5–10 | 1920 | 0.87 |
| SN1 | 190 | 220 | 5–10 | 1930 | 0.89 |
| DN | 250 | 300 | 5–10 | 1950 | 0.93 |
| DN | 260 | 290 | 5–10 | 1960 | 0.90 |
| SN2 | 240 | 270 | 1–3 | 1910 | 0.90 |
| SN2 | 250 | 280 | 1–3 | 1930 | 0.92 |

EXAMPLE 7

Other hot rolled coils of the heath described in the Example 6 were divided after annealing in two groups, to define the effect of the cold rolling reduction ratio on the final characteristics of the strips produced according to present invention. Six coils were produced according to the following cold rolling programs:

single stage from 2.1 mm to 0.35 mm (83% reduction) (S83);

single stage from 2.1 mm to 0.29 mm (86% red.) (S86);

single stage from 2.2 mm to 0.26 mm (88% red.) (S86);

single stage from 2.2 mm to 0.21 mm (90% red.) (S90);

double stage from 2.2 mm, with intermediate thickness of 0.7 mm, to 0.22 mm, with intermediate annealing at 900° C. for 40 seconds and 69% reduction in the second rolling stage (D69);

double stage from 2.2 mm, with intermediate thickness of 0.7 mm, to 0.22 mm, with intermediate annealing at 900° C. for 40 seconds and 75% reduction in the second rolling stage (D75);

double stage from 2.2 mm, with intermediate thickness of 0.7 mm, to 0.22 mm, with intermediate annealing at 900° C. for 40 seconds and 83% reduction in the second rolling stage (D83);

double stage from 2.2 mm, with intermediate thickness of 1.5 mm, to 0.22 mm, with intermediate annealing at 900° C. for 40 seconds and 85% reduction in the second rolling stage (D85).

The cold rolled strips were then treated according to the following continuous annealing cycle;

first zone, treatment at 870° C. for 180 seconds in a wet nitrogen-hydrogen atmosphere with a $pH_2O/pH_2$ ratio of 0.58;

second zone, treatment at 970° C. for 25 seconds in a wet nitrogen-hydrogen atmosphere with a $pH_2O/pH_2$ ratio of 0.05, mixed with ammonia injected at a variable equivalent flow rate;

third zone, treatment at 1100° C. for 50 seconds in a wet nitrogen-hydrogen atmosphere with a $pH_2O/pH_2$ ratio of 0.01;

cooling in dry nitrogen to 200° C. and then air cooling to room temperature.

The ammonia flow rate in the second zone was modulated depending on the strip thickness, to obtain a total nitrogen content at the end of the treatment comprised between 180 and 210 ppm.

At the end of the treatment, the test strips were sampled for analysis and then annealed at 1200° C. for 4 hours (including the heating time from 250° C.) to complete the secondary recrystallization and to purify them.

In Table 8 for each test are shown the amount of aluminium precipitated as nitride, the mean dimension of the grain into which the secondary recrystallized grains are immersed after the continuous annealing, and the B800 resulting after purification. In all cases the secondary grain fraction visible with the naked eye after acid pickling was comprised between 1 and 3%.

TABLE 8

| | Continuous annealing | | |
|---|---|---|---|
| | Al as AlN (ppm) | Mean grain diameter ($\mu$m) | Final annealing B800 (mT) |
| S83 | 190 | 24 | 1910 |
| S86 | 200 | 22 | 1920 |
| S88 | 180 | 23 | 1930 |
| S90 | 210 | 19 | 1920 |
| D69 | 200 | 27 | 1640 |
| D75 | 200 | 28 | 1840 |
| D83 | 190 | 25 | 1910 |
| D87 | 190 | 23 | 1920 |

It must be noted that, in the single stage cold rolling tests, due to specific plant and process conditions it was impossible to use reduction ratios sensibly lesser than 80%. However, it can be seen the strong dependence of the final quality on the reduction ratio in the double stage cold rolling.

EXAMPLE 8

A hot rolled strip of Example 6 was continuously annealed at 1100° C. and then cold rolled at 0.26 mm. Different portions of the strip were continuously annealed according to the following cycles:

A)

first zone, treatment at 870° C. for 180 seconds (comprising the heating to treatment temperature, of 50 s) in wet nitrogen-hydrogen atmosphere with a $pH_2O/pH_2$ ratio of 0.58;

second zone, treatment at 1000° C. for 50 seconds in wet nitrogen-hydrogen atmosphere with a $pH_2O/pH_2$ ratio of 0.1, mixed with ammonia;

third zone, treatment at 1100° C. for 50 seconds in wet nitrogen-hydrogen atmosphere with a $pH_2O/pH_2$ ratio of 0.01.

Or

B)

first zone, treatment at 870° C. for 180 seconds (comprising the heating to treatment temperature, of 2 s) in wet nitrogen-hydrogen atmosphere with a $pH_2O/pH_2$ ratio of 0.58;

second zone, treatment at 1000° C. for 50 seconds in wet nitrogen-hydrogen atmosphere with a $pH_2O/pH_2$ ratio of 0.1, mixed with ammonia;

third zone, treatment at 1100° C. for 50 seconds in wet nitrogen-hydrogen atmosphere with a $pH_2O/pH_2$ ratio of 0:01;

The quick heating in case B was obtained utilising an induction heating in the first annealing phase.

Samples of the above annealed strips were then treated according to the following final annealing cycles:

1. from 600 to 1200° C. in 35 hours in $N_2/H_2$ (1:3), soaking at 1200° C. for 5 hours in $H_2$;
2. from 600 to 1200° C. in 10 hours in $N_2/H_2$ (1:3), soaking at 1200° C. for 5 hours in $H_2$;

The results are shown in Table 9.

TABLE 9

| | B800 (mT) | P17 (W/kg) |
|---|---|---|
| Cycle A - cycle 1 | 1920 | 0.96 |
| Cycle A - cycle 2 | 1910 | 0.98 |
| Cycle B - cycle 1 | 1920 | 0.92 |
| Cycle B - cycle 2 | 1930 | 0.90 |

EXAMPLE 9

A hot rolled strip of Example 5 was cold rolled at 0.29 mm. Different strip portions were continuously annealed according to the following cycle:

first zone, treatment at 870° C. for 180 seconds (comprising the heating to treatment temperature, of 50 s) in wet nitrogen-hydrogen atmosphere with a $pH_2O/pH_2$ ratio of 0.58;

second zone, treatment at different temperatures in a wet nitrogen-hydrogen atmosphere containing ammonia, the latter having a variable equivalent flow rate, for 50 seconds, in order to introduce in all the samples a given nitrogen quantity of about 150 ppm;

third zone, treatment at 1100° C. for 100 seconds in wet nitrogen-hydrogen atmosphere with a $pH_2O/pH_2$ ratio of 0,01.

The nitriding temperatures were 750, 850 and 950° C.

The final annealing after coating with MgO based annealing separator was carried out according to the following cycle:

heating from 100 to 1150° C. in 5 hours, in nitrogen-hydrogen;

soaking at 1050° C. for 10 hours in dry hydrogen;

cooling.

The results, in terms of total nitrogen after continuous annealing, and of magnetic characteristics after final annealing are shown in Table 10.

TABLE 10

| Nitriding temp. ° C. | Total nitrogen (ppm) | B800 (mT) | P17 (W/kg) |
|---|---|---|---|
| 750 | 200 | 1540 | 2.25 |
| 850 | 210 | 1850 | 1.26 |
| 950 | 190 | 1910 | 0.98 |

What is claimed is:

1. A process for controlling and guiding secondary recrystallization in the production of oriented grain silicon electrical steel strips by means of second phases dispersed throughout the steel, comprising in sequence the steps of cold rolling a strip of silicon steel comprising, in wt %, C 0.003–0.08, Al 0.01–0.04, N≦0.01, Mn 0.03–0.40, to obtain a cold rolled strip, continuously annealing said cold rolled strip to carry out the primary recrystallization process as well as growth of crystal grains, continuously annealing for nitriding the primary recrystallized strip, and annealing for final purification, characterized by the combination of the following points: (i) the strip to be cold rolled already contains second phases able to inhibit grain growth, distributed throughout the matrix and comprising at least one element selected from the group consisting of sulfur, nitrogen and selenium, in such a quantity and distribution that an Iz index, defined according to the relation $$Iz=1.9\ fv/r$$

in which fv and r are, respectively, the volumetric fraction and the mean dimensions of said second phases is comprised between 300 and 1400 $cm^{-1}$; (ii) further precipitates evenly distributed throughout the strip thickness and useful for controlling and guiding the secondary recrystallization are produced during said continuous annealing for nitriding; and (iii) after said nitriding step, a continuous annealing step is carried out to at least initiate the oriented secondary recrystallization.

2. The process according to claim 1, wherein during the cold rolling of the silicon steel strip at least one deforming step is carried out, without intermediate annealing, with a reduction rate higher than 70%.

3. The process according to claim 1, wherein the silicon steel strip comprises, in wt %, C 0.003–0.008, Al 0.01–0.04, N≦0.01, Mn 0.03–0.40, (S+Se)≦0.03, Sn≦0.2, Cu≦0.40, characterized by the combination of the following steps: (i) continuous annealing for primary recrystallization and grain growth at temperatures of between 700 and 1000° C.; (ii) nitriding continuous annealing at temperatures of between 800 and 1100° C.; (iii) secondary recrystallization continuous annealing at temperatures of between 1000 and 1200° C., at the end of which the secondary recrystallization is at least initiated; (iv) purification annealing at a temperature higher than 1100° C., for a time not less than 15 minutes.

4. The process according to claim 3, wherein after the start of secondary recrystallization a further nitriding treatment is carried out at a temperature of between 900 and 1100° C.

5. The process according to claim 3, wherein during said continuous annealing for primary recrystallization a decarburization step is carried out.

6. The process according to claim 3, wherein during said purification annealing the oriented secondary recrystallization is completed.

7. The process according to claim 3, wherein all the steps are carried out continuously, but the last one (purification annealing) which can be a static annealing.

8. The process according to claim 1, in which the silicon steel strip comprises, in wt %, C 0.003–0.08, Al≦0.04, N≦0.01, Mn≦0.40, (S+Se)≦0.005, Cu≦0.3, Sn≦0.20, comprising the following steps: (i) annealing for primary recrystallization and grain growth at temperatures of between 700 and 1000° C.; (ii) nitriding annealing at temperatures of between 800 and 1100° C.; (iii) secondary recrystallization annealing at temperatures of between 1000 and 1200° C., at the end of which the secondary recrystallization is completed; in which process all the above steps are continuous ones.

9. Process according to claim 7, wherein a decarburization treatment is carried out during said primary recrystallization annealing.

10. Process according to claim 3, wherein: (i) said primary recrystallization annealing is carried out at temperatures of between 900 and 1000° C.; (ii) said nitriding is carried out at temperatures of between 900 and 1000° C.; (iii) said secondary recrystallization annealing is carried out at temperatures of between 1050 and 1150° C.; (iv) said purification annealing is carried out at temperatures of between 1150 and 1250° C.

11. Process according to claim 3, wherein at least part of the above annealing steps comprises heating at a speed of between 400 and 800° C./s.

12. A hot rolled silicon steel strip, to be transformed into grain oriented electrical steel strip for electromagnetic applications, produced according to claim 1, characterized by a content before cold rolling of second phases distributed throughout the matrix and comprising at least one element selected from the group consisting of sulfur, nitrogen and selenium, in quantity and distribution such that Iz is comprised between 300 and 1400 $cm^{-1}$ according to the relation $$Iz=fv/r$$

in which fv and r are, respectively, the volumetric fraction and the mean dimensions of the second phases.

13. A cold rolled silicon steel strip, to be transformed into grain oriented electrical steel strip for electromagnetic applications, produced according to claim 1, which is treated for primary recrystallization grain growth and possibly decarburization, and for nitriding, characterized in that at the end of said nitriding treatment all the second phases directly necessary for the control and guide of oriented secondary recrystallization are present evenly distributed throughout the strip thickness.

14. A cold rolled and primary recrystallized silicon steel strip, to be transformed into grain oriented electrical steel strip for electromagnetic applications, produced according to claim 1, further treated in continuous annealing to at least initiate the secondary recrystallization, characterized by a content, after said continuous annealing, of oriented secondary recrystallized grains having dimensions of at least 0.3 mm.

* * * * *